United States Patent [19]

Gottling et al.

[11] Patent Number: 4,910,491

[45] Date of Patent: Mar. 20, 1990

[54] ELECTRICAL APPARATUS USED WITH A POTENTIOMETER AND/OR VARIABLE RESISTANCE ELEMENT

[75] Inventors: Helmut Gottling, Isernhagen; Ralf Kook, Hanover; Rudolf Moller, Gehrden; Peter Muller, Hanover; Gerhard Scharnowski, Gehrden, all of Fed. Rep. of Germany

[73] Assignee: WABCO Westinghouse Steuerungstechnik GmbH, Hanover, Fed. Rep. of Germany

[21] Appl. No.: 118,363

[22] Filed: Nov. 6, 1987

[30] Foreign Application Priority Data

Nov. 15, 1986 [DE] Fed. Rep. of Germany ..... 3639150

[51] Int. Cl.[4] ..... H01C 10/38

[52] U.S. Cl. ..... 338/176; 338/32 R; 338/32 H

[58] Field of Search ..... 338/32 R, 325, 176

[56] References Cited

U.S. PATENT DOCUMENTS

| | | | |
|---|---|---|---|
| 4,125,821 | 11/1978 | Masuda | 338/32 R |
| 4,132,970 | 1/1979 | Masuda et al. | 338/32 R |
| 4,227,171 | 10/1980 | Masuda et al. | 338/32 R |
| 4,423,406 | 12/1983 | Nakano | 338/32 R |
| 4,602,513 | 7/1986 | Hirota et al. | 338/32 R X |

*Primary Examiner*—E. A. Goldberg
*Assistant Examiner*—M. M. Lateef
*Attorney, Agent, or Firm*—J. O. Ray, Jr.

[57] ABSTRACT

An electrical apparatus is provided for use with a potentiometer or variable resistance element which does not require a mechanical connection between a contact member and an activating mechanism. This is accomplished by using a magnet in at least a portion of either the contact member or the activating mechanism while constructing at least a portion of the other of such contact member and the activating mechanism of a ferromagnetic material.

19 Claims, 3 Drawing Sheets

ELECTRICAL APPARATUS USED WITH A POTENTIOMETER AND/OR VARIABLE RESISTANCE ELEMENT

FIELD OF THE INVENTION

The present invention relates, in general, to electrical equipment and, more particularly, this invention relates to an electrical apparatus for use in conjunction with a potentiometer and/or a variable resistance element.

BACKGROUND OF THE INVENTION

Although the invention is not limited thereto, it will be exlained hereinafter for a use in which it has particular utility. Such use is determining a position of a member in a fluid pressure activated work cylinder.

Prior to the present invention, it has been known in the prior art to use potentiometers in this application. See, for example, German publication DE 35 20 199A1. The potentiometer taught in this publication includes a resistance track and a contact member. The contact member is moved and guided along the resistance track by means of an activating member. The resistance track and contact member are generally positioned within a housing in order to provide protection of such contact member and the resistance track against dust and humidity which can damage the components. The activating member generally consists of a rod-like-shaped body. This rod-shaped activating member projects through an opening which is provided in the housing. A sealing means is provided to seal the rod-shaped activating member at the opening of the housing.

When the potentiometer described above is used for indicating the relative position of a piston in a work cylinder, it is necessary to arrange the resistance track mounting so that it can be rigidly attached to the housing of the work cylinder and to connect the activating member with either the piston or with the piston rod of such work cylinder.

For the purpose of operational integrity, it is an advantage to provide an arrangement of the contact member in such a way that it is relatively secured against an undesirable rotation on a theoretical axis which is in the direction of the movement of the contact member along the resistance track.

Furthermore, in order to enable rotation of the piston rod about its longitudinal axis in relation to the work cylinder, it has been taught, in the above-referenced German publication, that a joint is necessary. This joint is located between the activating member and the contact member. This arrangement on the joint constitutes a greater utilization of components which will be subjected to wear. In addition, this arrangement results in a relatively high level of manufacturing tolerances which add to the equipment costs as well as to the maintenance costs.

SUMMARY OF THE INVENTION

The present invention provides an electrical apparatus which can be used in conjunction with a potentiometer and/or a variable resistance element. As used hereinafter, the term variable resistance element includes a component known in the electrical art as a modifiable resistance. The electrical apparatus of the present invention includes a resistance track which is electrically connected to a source of electrical power. A contact member is provided and is engageable with such resistance track. The contact member is positioned for movement along the resistance track and by changing a position of such contact member along such resistance track a measurable voltage change of the resistance track is effected. In order to effect a position change of such contact member along the resistance track, the electrical apparatus includes an activating means which is positioned adjacent the contact member. One of the contact member and the activating means includes a permament magnet while an opposite one of such contact member and such activating means includes a ferromagnetic material. This enables the activating means to effect the position change of such contact member along the resistance track in a manner that does not require a direct connection of the activating member with the contact member.

OBJECTS OF THE INVENTION

It is, therefore, one of the primary objects of the present invention to provide an electrical apparatus for use in conjunction with a potentiometer and/or a variable resistance element in which a relative motion, i.e., a rotation, will be possible between the contact member and the mounting member.

Another object of the present invention is to provide an electrical apparatus for use in conjunction with a potentiometer and/or a variable resistance element that minimizes the number of components which will require close manufacturing tolerances.

A further object of the present invention is to provide an electrical apparatus for use in conjunction with a potentiometer and/or a variable resistance element which eliminates the mechanical connection between the activating means and the contact member.

An additional object of the present invention is to provide an electrical apparatus for use in conjunction with a potentiometer and/or a variable resistance element which will reduce the maintenance costs of the equipment.

Still another object of the present invention is to provide an electrical apparatus for use in conjunction with a potentiometer and/or a variable resistance element that allows a freely moving activating member to move the contact member.

Yet a further object of the present invention is to provide an electrical apparatus for use in conjunction with a potentiometer and/or a variable resistance element which eliminates the need for a seal by eliminating the need for an opening in the housing of a work cylinder.

The above and various other objects and advantages of the present invention will become more readily apparent to those persons skilled in the potentiometer art from the following more detailed description of the invention when such description is taken in conjunction with the attached drawings and with the appended claims.

BRIEF DESCRIPTION OF THE INVENTION

Figure 1:
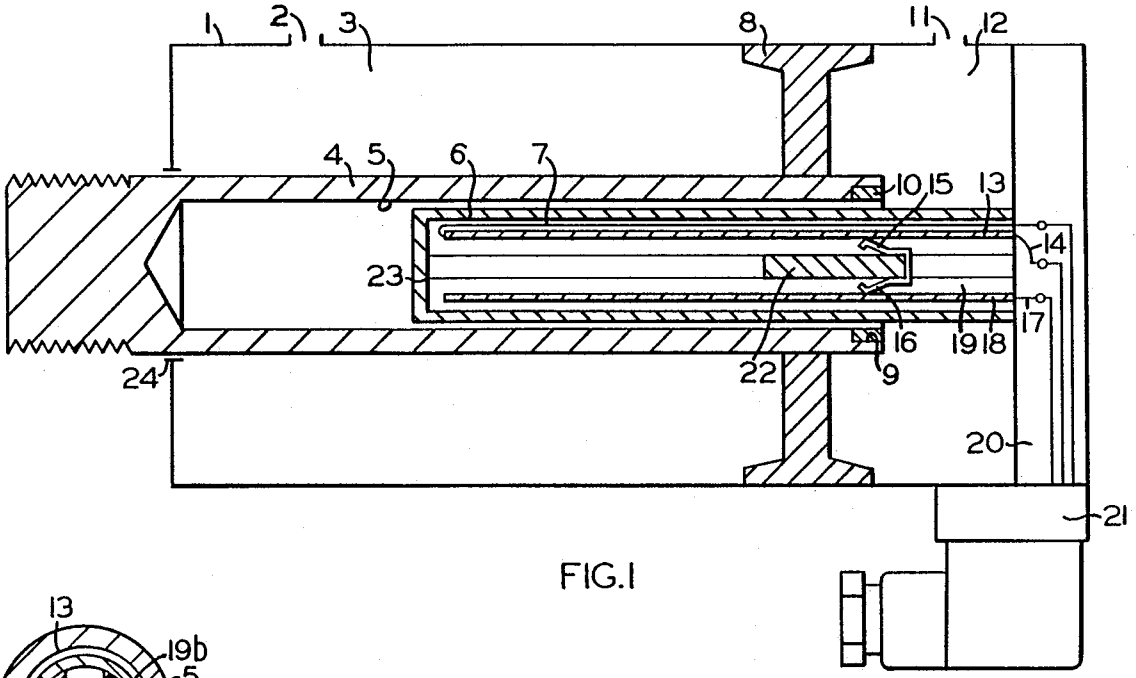
FIG. 1 is a side elevation view partially in cross-section which illustrates an embodiment of the invention as used with a work cylinder that is equipped with a potentiometer which is secured to the bottom of the work cylinder and projects into a cavity formed in the piston rod and wherein a permanent magnet mounted on such piston rod serves a an activating member.

In the description of the invention which follows, it should be noted that identical components in the several views have been designated with identical reference numerals.

As the description proceeds, it should be kept in mind that the term variable resistance element also includes a modificable resistance in the specification and appended claims.

Figure 2:
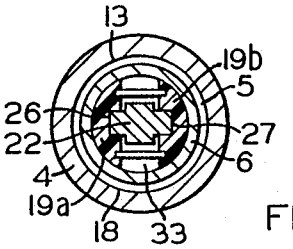
FIG. 2 is a cross-sectional view taken through the piston rod and potentiometer illustrated in FIG. 1.

Now refer more particularly to FIGS. 1 and 2 for an understanding of a first embodiment of the present invention. Illustrated in FIG. 1 is a work cylinder 1 equipped with a fluid pressure responsive piston 8 connected to a piston rod 4 adjacent one end thereof. The piston rod 4 is sealed adjacent the counterbore 24 of the work cylinder 1. The piston 8 moves reciprocally within the work cylinder 1. It can be seen that the piston 8 divides the work cylinder 1 into a first fluid pressure chamber 3 at the piston rod 4 end adjacent a first face of the piston 8 and a second fluid pressure chamber 12 adjacent an opposite face of the piston 8. The fluid pressure chamber 3 is connected to a source of fluid pressure (not shown) at a connection 2 in the side wall of the work cylinder 1 while the fluid pressure chamber 12 is connected to the fluid pressure source (not shown) via a connection 11 in the side wall of the work cylinder 1. Also not illustrated is a valve arrangement connected between the fluid pressure source and the fluid pressure chambers 3 and 12.

The piston rod 4 includes a cavity 5 which is cylindrical in a presently-preferred embodiment. The cavity 5 is located along the longitudinal axis of the piston rod 4 and begins at the end of the piston rod 4 which enters into the work cylinder 1 and proceeds in the direction of the counterbore 24 located at the bottom of the work cylinder 1 and through which the tail end of the piston rod 4 exits such work cylinder 1. The piston 8 and the piston rod 4 are constructed in such a manner that, once they are connected together, the end of the piston rod 4, having the cavity 5 located therein and which lies within the work cylinder 1, leads substantially through the center of the piston 8.

A tubular body 6, which in a presently-preferred embodiment is cylindrical-shaped and made of a non-magnetic material such as aluminum or plastic, is rigidly attached to the cover 20 of the work cylinder 1. The tubular body 6 is positioned coaxial to the piston rod 4 and projects into the cavity 5 of such piston rod 4. A bottom member 23 closes one end of the tubular body 6 which extends into the cavity 5 at the free end of the piston rod 4 to assure that the inner space of such tubular body 6 is sealed against the entrance thereto of fluid pressure entering the second fluid pressure chamber 12. The tubular body 6 is substantially surrounded by a permanent magnet 10 which serves as the activating member of this embodiment of the electrical apparatus. The permanent magnet 10 is secured to the piston rod 4 adjacent an end thereof in a cavity 9 which faces the tubular body 6. The tubular body 6 includes a plastic mount 19 for a resistance track 13 as well as a guide means 18.

The presently-preferred mount 19 can, as best seen in FIG. 2, consist of two identical and symetrically arranged portions 19*a* and 19*b*. The contour of the outer portion of the mount 19 is generally shaped to suit the contour of the inside wall of the tubular body 6. At least one, but preferably two keyway slots 26 and 27 are provided in the mount 19 in the direction of the longitudinal axis of such mount 19. These keyway slots 26 and 27 are used to guide the contact member which, in FIG. 1, is generally designated 40. The contact member 40 consists of a slideable portion 22, manufactured from a ferromagnetic material, and at least one, but preferably two slip contacts 15 and 16, which are engaged with the slideable portion 22 and which engage the resistance track 13. The resistance track 13 and the guide 18 are fitted substantially parallel to the longitudinal axis of the slideable portion 22 of the contact member 40 with the respective keyway cavities for components 19*a* and 19*b* to establish the desired arrangement with respect to the slideable portion 22 in such a manner that the resistance track 13 will work together with the slip contact 15 and the guide 18, as well as the slip contact 16, when such slip contact 16 is provided in the electrical apparatus of the present invention. As best illustrated in FIG. 2, the slideable portion 22 of the contact member 40, which carries the slip contacts 15 and 16, has a cross-like profile and has adjacent its free end section a stepped portion for securement of the slip contacts 15 and 16 thereto. The slip contacts 15 and 16 act in a spring-like manner against the resistance track 13 and the guide 18.

The resistance track 13 and the guide 18 include electrical connections which are connected to electrical cables 7, 17 and 14. The electrical cables 7, 17 and 14 lead to a plug 21 that is positioned on the work cylinder 1.

The operation of the electrical apparatus used in conjunction with a potentiometer connected to a work cylinder will now be described. For the purpose of this description of the operation of the electrical apparatus, it is assumed that fluid pressure is being communicated into the second fluid pressure chamber 12 by way of the pressure connection 11. As the fluid pressure begins to build up in the second fluid pressure chamber 12, it will cause the piston 8 to move to the left in the direction of the first fluid pressure chamber 3. As this occurs, the fluid pressure in the first fluid pressure chamber 3 will be gradually reduced to atmospheric pressure. This fluid pressure reduction in the first fluid pressure chamber 3 occurs through the first fluid pressure connection 2 and the valving which has not been illustrated since it forms no part of the present invention. As the piston 8 and piston rod 4 move because of the magnetic force of the permanent magnet 10 which serves as the activating member and which is mounted on the piston rod 4 the slideable portion 22 of the contact member 40 and which carries the slip contacts 15 and 16 thereon will also be moved to the left away from the cover 20 of the work cylinder 1. This movement to the left occurs without any physical contact occurring between the contact member 40 and the activating means 10. Furthermore, the movement of the contact member 40 is substantially synchronous to the movement of the piston 8 and the piston rod 4.

It is obvious that by changing the position of the contact point on the resistance track 13 a change in the measurable voltage at the resistance track 13 will be accomplished. The measured voltage of the resistance track is fed to an analyzer which forms no part of the present invention and is not illustrated in the drawings for this reason. After analysis of the measured voltage by the analyzer, it will generate signals that will reflect the respective piston 8 position.

As the activating means, which in this case is a permanent magnet 10, and the ferromagnetic material in the contact member 40 will substantially remain in the same level and because the activating means is connected at a known position on the piston rod 4, the precise position of the piston 8 will be known at any given time.

Figure 3:
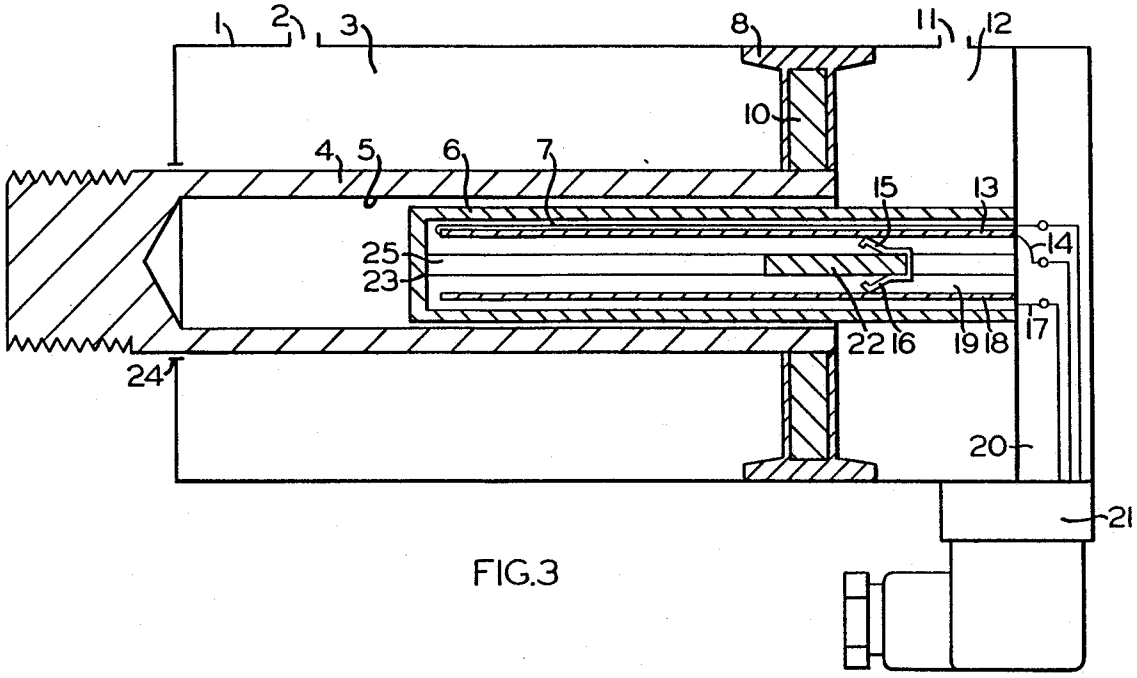
FIG. 3 is a side elevation view partially in cross-section which illustrates an alternative embodiment of the invention illustrated in FIG. 1 in which the contact member includes a permanent magnet and the activating member potentiometer consists of a ferromagnetic portion of the work piston of the work cylinder.

Now refer more particularly to FIG. 3 of the drawings which illustrates an alternative embodiment of the electrical apparatus of the present invention in which a work cylinder 1 includes an integral potentiometer. In this alternative embodiment, at least a portion of the activating means 10 consists of a ferromagnetic material and at least a portion of the contact member, generally designated 50, is formed of a magnetic material such as a permanent magnet.

According to the alternative embodiment illustrated in FIG. 3, the piston 8 is connected with the piston rod 4 and is positioned for reciprocal movement within the work cylinder 1 and in a manner such that it is sealed. As in the first embodiment, the piston 8 divides the work cylinder 1 into a first fluid pressure chamber 3 on the side of the work cylinder 1 through which the piston rod 4 enters and a second fluid pressure chamber 12 on an opposite side of the piston 8. These two fluid pressure chambers 3 and 12 are connected by way of a respective fluid pressure connection 2 and 11 on the wall of the work cylinder 1. The valve arrangement and the fluid pressure source for operation of the work cylinder 1 do not form a port of the invention and for the sake of clarify have not been illustrated. Furthermore, persons skilled in the art are familiar with such valve arrangement.

The piston rod 4 includes a cavity 5 formed therein. In the presently-preferred embodiment, this cavity 5 will be generally cylindrical in cross-section and extend in a longitudinal direction beginning at the end of the piston rod 4 which projects into the work cylinder 1 and extends like a counterbore in the direction of the opening 24 in the work cylinder 1 bottom through which the tail end of the piston rod 4 projects to the outside of such work cylinder 1. The piston 8 and the piston rod 4 are preferably formed in such a way and connected together in a manner such that the end of the piston rod 4 projects substantially through the center of the piston 8 within the work cylinder 1 and closes the side of the piston 8 which is adjacent the second fluid pressure chamber 12.

A tubular body 6, which is preferably cylindrical in cross-section, made of a non-magnetic material such as aluminum or plastic, is connected to the cover 20 of the work cylinder 1 in such a way that it lies coaxially to the piston rod 4. The tubular body 6 projects into the cavity 5 of such piston rod 4. The tubular body 6 is closed at its free end with a bottom 23 thus closing off the inner space of such tubular body 6 against the fluid pressure in the second fluid pressure chamber 12 in the work cylinder 1.

A mounting member 19 is contained in the tubular body 6 for mounting a resistance track 13 and a guide 18. The mounting member 19 is plastic in a presently-preferred embodiment while the guide 18 is of a conductive material. The outer shape of the mounting member 19 is generally the same as the shape of the inner wall of the tubular body 6. The mounting member 19 can be designed such that the guide 18 for the contact member, generally designated 50, forms an integral part thereof. In this embodiment, the resistance track 13 is rigidly connected to the guide 18 components. Activation of the contact member 60 is achieved without physical contact of the activating means, generally designated 60, by means of a magnetic force. For this purpose, longitudinal keyways are provided along the longitudinal axis of the mounting member 19. The contact member 50 includes a sliding portion 22 of magnetic material and a pair of slip contacts 15 and 16 mounted on the sliding portion 22.

In the embodiment being described, the activating means 60 is a disk-shaped part 9 formed of a ferromagnetic material and positioned in the piston 8. Electrical conductors 7, 17 and 14 are connected to the resistance track 13 and the conductor 18 to connect them with a plug 21 on the work cylinder 1.

Alternatively, it would not be necessary to provide a separate disk-shaped part 9 positioned on the piston 8 to act as the activating member 10 providing the piston 8 as such would consist of a disk-shaped body of ferromagnetic material such as steel. In this case, the piston 8 would require a sealing element adjacent its periphery.

The operation of the above-described alternative embodiment of the invention is identical to the embodiment described with reference to FIG. 1. However, the activating means 60 in this case consists of a ferromagnetic material or at least contains a portion of ferromagnetic material while the contact member 50 consists of a magnetic material or at least contains a portion of magnetic material.

Figure 4:
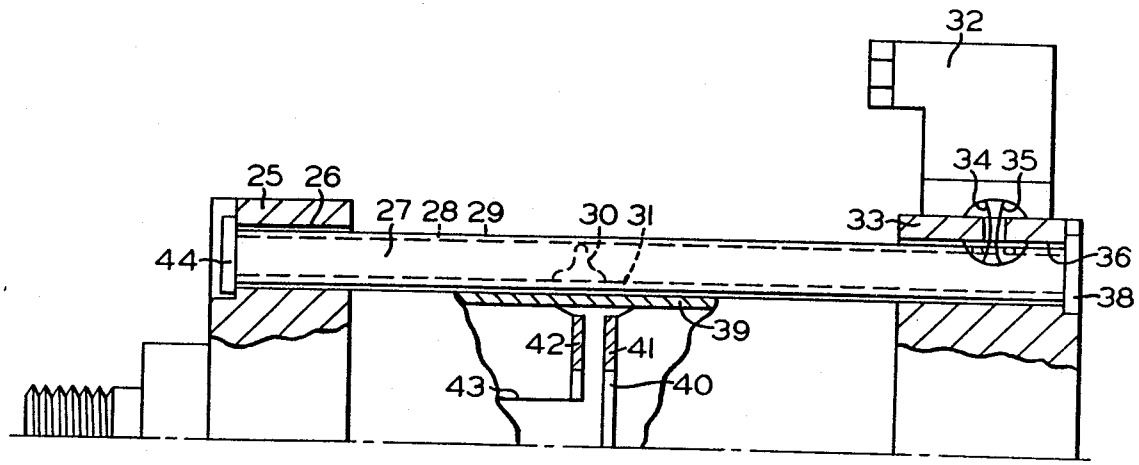
FIG. 4 is a side elevation view partially in cross section which illustrates another alternative embodiment of the present invention in which a work cylinder equipped with a potentiometer and includes a permanent magnet positioned in the work piston to serve as the activating member.

Now refer more particularly to FIG. 4 for an understanding of another alternative embodiment of the electrical apparatus of the present invention. There is illustrated in FIG. 4 a portion of a work cylinder which consists of a cylinder 39, a cylinder bottom 33, a cover 25, as well as a piston 40 connected to a piston rod 43 which are positioned within the cylinder 39 and sealed. The cylinder bottom 33 and the cover 25 are located at opposite ends of the cylinder 39 and held tightly against a respective face of the cylinder 39 by means of tie rods.

For the sake of clarity, only one tie rod 27 has been shown in FIG. 4. The tie rod 27 extends through a bore 36 in the longitudinal direction of the cylinder 39. The bore 36 is located in a portion of the cylinder bottom 33 which projects beyond the cylinder 39 proper at one end. The tie rod 27 is parallel to the longitudinal axis of the cylinder 39 and extends through another bore 26 in the cover 25. Such bore 26 being positioned through a portion of such cover 25 which projects outwardly from the cylinder 39 housing. The bore 26 is substantially axially opposite the bore 36. A pair of nuts 38 and 44 are threadedly engaged on the respective ends of the tie rod 27 thereby holding the cylinder bottom 33 and the cover 25 tightly in place at their respective ends of the cylinder 39.

In the tie rod 27 a cavity 29 is provided. The cavity 29 extends through the tie rod 27 in the direction of the longitudinal axis of such tie rod 27. The electrical apparatus of the present invention incorporated into a potentiometer is mounted in the cavity 29 of the tie rod 27. The electrical apparatus consists of a resistance track 28, a return guide member 31 and a contact member 30. The housing of the potentiometer in this embodiment is formed by the tie rod 27. The contact member 30 in this embodiment acts as a slip contact and is preferably made of a ferromagnetic material. When such contact member 30 is a ferromagnetic material, the activating means will be permanent magnets 41 and 42 which would be mounted on the piston 40. The resistance track 28 and the return guide 31 for the potentiometer are electrically connected by means of wires 34 and 35 to a plug 32 which is positioned adjacent the bottom 33 of the work cylinder.

If desired, in this embodiment of the present invention, it is possible to mount the potentiometer having its own housing inside the cavity 29 of the tie rod 27. In such an installation, it would not be necessary to provide closures for the cavity 29 in the tie rod 27 which is designated to receive the potentiometer in order to prevent undesirable dirt and/or moisture from gaining entrance into the potentiometer.

It should be pointed out that the present invention not only covers the examples described in detail above, but a number of additional alternatives are within the scope of the invention.

For example, it is possible to equip both the contact member and the activating means with at leasat one permanent magnet. In this manner, the contact member can be made self-supporting. By making the contact member self-supporting, it eliminates the necessity for a mount for the slip contacts. In such a design, the contact members such as the slip contacts can consist either of a ferromagnetic material or a magnetic material. It is also possible to shape the contact members in such a way that they can be moved along the resistance track without danger of rotating or tipping.

It can be seen from the above description of the present invention that it meets the stated objects of the invention by providing an electrical apparatus that can be utilized with a potentiometer as well as a variable resistance element. The individual components of the potentiometer or variable resistance element can be positioned into a housing so that an independent arrangement is formed, which is suitable for a number of independent purposes and can be added to several pieces of equipment and installations. The activating means for these independent installations, i.e., potentiometer or variable resistance element, on which the resistance track and the contact member containing housing can be adjusted by means of a circular body, will contain a permanent magnet or a ferromagnetic material.

The present invention offers the distinct advantage of providing an electrical apparatus for use with a potentiometer or a variable resistance element which includes a freely movable activating means which moves a contact member without the necessity of providing a mechanical connection between such contact member and the activating means. In this manner, the advantage can be gained of permitting the activating means and the unit to which it is connected, such as the piston or the piston rod of a work cylinder, to be rotated relative to the piston as well as to the resistance track or to the cylinder proper.

Furthermore, when the potentiometer or variable resistance element is arranged in a housing, a special seal for sealing the contact member and the space for the resistance track will no longer be necessary. The reason this special seal can be eliminated is that the housing which encloses this space will no longer require an opening to provide the direct mechanical connection to the activating means of the contact member.

If a contact member of the potentiometer or variable resistance element of the present invention is constructed in such a manner that it will contain a permanent magnet, then the potentiometer or the variable resistance element can be arranged in such a way that the position of the piston of a work cylinder can be added at a later time to the work cylinder. The piston in this work cylinder will include at least in part a ferromagnetic material. It can be seen that, in such a case, it is no longer necessary to provide a mechanical connection between the contact member and the activating means to successfully operate a potentiometer or variable resistance element constructed according to the present invention.

While a number of presently-preferred embodiments of an electrical apparataus for use in conjuntion with a potentiometer and a variable resistance element have been described in detail above it should be obvious to persons skilled in the electrical art that various other modifications and adaptations can be made to such electrical apparatus without departing from the spirit and scope of the appended claims.

We claim:

1. A pressure medium actuated work cylinder having an electrical apparatus for use in conjunction with at least one of a potentiometer and a variable resistance element to determine a relative position of a movable piston in said pressure medium actuated work cylinder, said pressure medium actuated work cylinder comprising:

(a) a work cylinder, said work cylinder including;
  (i) a generally hollow outer body member closed at each end thereof by an end wall,
  (ii) a movable piston member, having an aperture therethrough located substantially at a center portion thereof, positioned within said generally hollow outer body portion, said piston member dividing said generally hollow outer body member into a pair of pressure chambers,
  (iii) a piston rod connected at one end thereof to said piston member adjacent said aperture and extending out of a first end wall of said generally hollow outer body member, said piston rod includes a hollow portion extending inwardly from said one end,
  (iv) a first fluid pressure connection formed in said work cylinder to allow fluid communication to a first of said pair of pressure chambers, and
  (v) a second fluid pressure connection formed in said work cylinder to allow fluid communication to a second of said pair of pressure chambers; and (b) an electrical means at least a portion of which is positioned within said generally hollow outer body member of said work cylinder for determining said relative position of said movable piston member, said electrical means includes:

(i) a housing member secured to a second wall of said generally hollow outer body member and extending into said aperture of said movable piston member and said hollow portion of said piston rod positioned for reciprocal movement within said work cylinder, said generally hollow portion extending in a longitudinal direction of said piston rod, said housing member and said movable piston member arranged such that they can be adjusted relative to one another;

(ii) a resistance track positioned within said housing member;

(iii) a contact member engaging said resistance track and positioned for movement along said resistance track, changing a position of said contact member along said resistance track effecting a measurable voltage change of said resistance track;

(iv) an activating means positioned adjacent said contact member for effecting a position change of said contact member along said resistance track;

(v) one of said contact member and said activating means include a permanent magnet;

(vi) an opposite one of said contact member and said activating means including a ferromagnetic material thereby enabling said activating means to effect said position change of said contact member in a contactless manner, and (vii) means for supplying power to said electrical means connected to said work cylinder and to said resistance track.

2. A pressure medium actuated work cylinder, according to claim 1, wherein said activating means positioned adjacent said contact member is carried by one of said movable piston and said piston rod.

3. A pressure medium actuated work cylinder, according to claim 2, wherein one of said contact member and activating means is a permanent magnet.

4. A pressure medium actuated work cylinder, according to claim 3, wherein said activating means is a permanent magnet.

5. A pressure medium actuated work cylinder, according to claim 4, wherein said permanent magnet is positioned on said piston rod adjacent one end.

6. A pressure medium actuated work cylinder, according to claim 4, wherein said permanent magnet is positioned in said movable piston.

7. A pressure medium actuated work cylinder, according to claim 1, wherein said activating means is a ferromagnetic member.

8. A pressure medium actuated work cylinder, according to claim 7, wherein said activating means is positioned in said movable piston.

9. A pressure medium actuated work cylinder, according to claim 1, wherein said electrical means further includes a guide means positioned rigidly with respect to said resistance track for guiding said contact member along said resistance track.

10. A pressure medium actuated work cylinder, according to claim 9, wherein said guide means is a rigid guide positioned parallel to said resistance track and guides said contact member in a direction along a longitudinal axis of said resistance track.

11. A pressure medium actuated work cylinder, according to claim 10, wherein said contact member includes:

(a) a sliding member mounted for movement in said guide means; and (b) at least one slip contact member engageable with said resistance track.

12. A pressure medium actuacted work cylinder, according to claim 1, wherein said housing member is non-magnetic.

13. A pressure medium actuated work cylinder, according to claim 1, wherein said activating means is positioned in a movable manner outside said housing member and in a direction of a longitudinal axis of said housing member.

14. A pressure medium actuated work cylinder, according to claim 12, wherein said activating means is positioned in a movable manner outside said housing member and in a direction of a longitudinal axis of said housing member.

15. A pressure medium actuated work cylinder having an electrical apparatus for use in conjunction with at least one of a potentiometer and a variable resistance element to determine a relative position of a movable piston in said pressure medium actuated work cylinder, said pressure medium actuated work cylinder comprising:

(a) a work cylinder, said work cylinder including:

(i) a housing member; and (ii) a piston member positioned for reciprocal movement within said housing member; and (b) an electrical apparatus to determine a position of said piston member within said housing, said electrical apparatus includes:

(i) a resistance track positioned within said cavity of said at least one tie rod and connected to a source of power;

(ii) a contact member engaging said resistance track and positioned for movement along said resistance track, changing a position of said contact member along said resistance track effecting a measurable voltage change of said resistance track;

(iii) an activating means positioned within said piston and adjacent said contact member for effecting a position change of said contact members along said resistance track;

(iv) one of said contact member and said activating means including a permanent magnet; and (v) an opposite one of said contact member and said activating means including a ferromagnetic material thereby enabling said activating means to effect said position change of said contact member in a contactless manner.

16. A work cylinder, according to claim 15, wherein said one of said contact member and said activating means is a permanent magnet.

17. A work cylinder, according to claim 16, wherein said activating means is a permanent magnet.

18. A work cylinder, according to claim 15, wherein said apparatus further includes a guide means positioned rigidly with respect to said resistance track for guiding said contact member along said resistance track.

19. A work cylinder, according to claim 18, wherein said guide means is a rigid guide positioned parallel to said resistance track and guides said contact member in a direction along a longitudinal axis of said resistance track.

* * * * *